US006450712B1

(12) United States Patent
Shah et al.

(10) Patent No.: US 6,450,712 B1
(45) Date of Patent: Sep. 17, 2002

(54) METHOD AND APPARATUS FOR OPTIMIZING SUBSTRATE SPEED IN A PRINTER DEVICE

(75) Inventors: Dinesh S. Shah, Penfield, NY (US); Frederick A. Donahue, Walworth, NY (US); John F. Moreland, Fairport, NY (US); Thomas N. Taylor, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/770,245

(22) Filed: Jan. 29, 2001

(51) Int. Cl.[7] ..... B41J 2/01
(52) U.S. Cl. ..... 400/582; 400/120.01
(58) Field of Search ..... 400/582, 120.01; 101/488

(56) References Cited

U.S. PATENT DOCUMENTS 5,349,905 A 9/1994 Taylor
5,631,685 A * 5/1997 Gooray et al. ..... 347/102
5,712,672 A * 1/1998 Gooray et al. ..... 347/102
5,714,990 A 2/1998 Courtney
5,717,446 A * 2/1998 Teumer et al. ..... 347/35
5,757,407 A * 5/1998 Rezanka ..... 347/102
6,072,585 A * 6/2000 Dutton et al. ..... 358/1.12

* cited by examiner

*Primary Examiner*—Andrew H. Hirshfeld
*Assistant Examiner*—Charles H. Nolan, Jr.
(74) *Attorney, Agent, or Firm*—Oliff & Berridge, PLC; Eugene O. Palazzo

(57) ABSTRACT

A printer control apparatus and an algorithm for determining the peak instantaneous speed of a substrate through a thermal ink jet printer and a printer apparatus are disclosed herein. The printer includes a dryer module, a print head module, and a controller. The method includes determining the tolerable peak instantaneous speeds of the substrate through the print head and dryer modules, which by their sequential nature, operate out of phase from one another. The lower of the two speeds is then selected as the optimum instantaneous speed of the substrate through the printer. A controller in the printer carries out methods disclosed herein.

16 Claims, 5 Drawing Sheets

| mc vs ac | 4.6 | 0.023 | 0.011 | 1.5 | 2.5 | 3.5 | 4.3 | 8 | |
|---|---|---|---|---|---|---|---|---|---|
| ac | mc@1.5 | mc@2.5 | mc@3.5 | mc@4.3 | v | mcCutOff | v0 | | |
| 7.69 | 4.90 | 4.99 | 5.07 | 5.14 | 4.3 | 8 | 38.1 | | |
| 15.38 | 5.21 | 5.38 | 5.55 | 5.68 | 4.3 | 8 | 18.0 | | |
| 23.08 | 5.51 | 5.77 | 6.02 | 6.22 | 4.3 | 8 | 11.3 | | |
| 30.77 | 5.82 | 6.15 | 6.49 | 6.76 | 4.3 | 8 | 8.0 | | |
| 38.46 | 6.12 | 6.54 | 6.97 | 7.30 | 4.3 | 8 | 5.9 | | |
| 46.15 | 6.42 | 6.93 | 7.44 | 7.84 | 4.3 | 8 | 4.6 | | |
| 53.85 | 6.73 | 7.32 | 7.91 | 8.39 | 3.6 | 8 | 3.6 | | |
| 61.54 | 7.03 | 7.71 | 8.38 | 8.93 | 2.9 | 8 | 2.9 | | |
| 69.23 | 7.33 | 8.10 | 8.86 | 9.47 | 2.4 | 8 | 2.4 | | |
| 76.92 | 7.64 | 8.48 | 9.33 | 10.01 | 1.9 | 8 | 1.9 | | |
| 84.62 | 7.94 | 8.87 | 9.80 | 10.55 | 1.6 | 8 | 1.6 | | |
| 92.31 | 8.25 | 9.26 | 10.28 | 11.09 | 1.3 | 8 | 1.3 | | |
| 100 | 8.55 | 9.65 | 10.75 | 11.63 | 1.0 | 8 | 1.0 | | |
| 110 | 8.95 | 10.16 | 11.37 | 12.33 | 0.7 | 8 | 0.7 | | |
| 120 | 9.34 | 10.66 | 11.98 | 13.04 | 0.5 | 8 | 0.5 | | |
| 130 | 9.74 | 11.17 | 12.60 | 13.74 | 0.3 | 8 | 0.3 | | |
| 140 | 10.13 | 11.67 | 13.21 | 14.44 | 0.1 | 8 | 0.1 | | |
| 150 | 10.53 | 12.18 | 13.83 | 15.15 | 0.0 | 8 | 0.0 | | |

METHOD AND APPARATUS FOR OPTIMIZING SUBSTRATE SPEED IN A PRINTER DEVICE

BACKGROUND OF THE INVENTION

1. Field of the Invention

The present invention relates to a method and an apparatus for optimizing print head speed in an ink jet printer. More particularly, the present invention is directed at the algorithm used to optimize print head speed in a thermal ink jet printer.

2. Description of the Related Art

Today, greater demands are being placed on personal computing systems, be they PC or Macintosh or Unix based. With these increased demands come greater expectations of printers used as a part of the computing systems. Many prior printers do not possess optimized throughput or perform at optimal speeds. This is especially true of thermal ink jet ("TIJ") printers. They produce quality results at a price well below that of most laser printers. Thermal ink jet printers even print in color, thus providing a very versatile machine for home and office use. Nevertheless, such printers are not operating at a power level that optimizes throughput.

The present invention overcomes certain deficiencies known in the prior art. For example, commonly-owned U.S. Pat. No. 5,349,905, the contents of which are incorporated herein by reference, discloses a method and apparatus for controlling the power requirements of a printer. This is done by controlling the speed of the sheet transport system in accordance with the image density ("ID") of the image being produced. That is, an image having a high density will print slower than one having a low density. A controller controls the speed of a drive motor driving the transport assembly in accordance with the image density. However, this and other prior systems do not take into account that power consumption cycles of two or more modules of the printer may be out of phase with one another.

Commonly-owned U.S. Pat. No. 5,714,990 also deals with controlling the speed of an ink jet head in a thermal ink jet printer according to image density. A required print time for each swath of printed matter placed on a printed sheet is calculated based on image density. A maximum frequency for the firing of the ink jets is determined based on image density information. Like U.S. Pat. No. 5,349,905, the system of the '990 patent does not provide controls for altering the behavior when two or more modules simultaneously demand power from sources that are out of phase with each other. Instead, the system of the '990 patent controls printhead speed on the basis of image density only.

One difficulty of many prior systems is that they only take into consideration the power needs of the print head while ignoring the power needs of the dryer, which generally operates out of phase with the print head. Thus, prior systems are not concerned with the true ideal speed at which a sheet should be fed through a printer. Rather, they provide suboptimum speeds and in turn provide less than ideal productivity.

SUMMARY OF THE INVENTION

An important aspect of the present invention overcomes the problems associated with the prior art by providing an algorithm that takes into consideration the possibility that two or more printer modules operate out of phase with each other to determine an optimum speed for feeding a print substrate through a printer. The algorithm dynamically computes an image output terminal's (IOT's) real time maximum processing speed, which is constrained by specified available power that satisfies the power needs of the two modules whose power needs correlate with the print density (image area coverage ("AC")) and are deterministically out of phase with each other. In calculating the processing speed, the algorithm automatically optimizes the printer's throughput, while keeping the power within a specified allotment. The algorithm may be applied to a thermal ink jet ("TIJ") printer, where a print head module lays ink on a substrate pursuant to the specified area coverage, after which a dryer, e.g. a microwave dryer, dries the liquid portion of the ink on the substrate. Since the maximum power available to both modules is restricted, the process speed reduces as the area coverage increases and vice versa. However, due to a deterministic phase lag in the power requirements, the instantaneous tolerable peak module speeds may differ. Therefore, for optimum throughput, the maximum tolerable peak speeds must be dynamically computed in real time and the IOT is to be operated at the lower of the two speeds.

The optimum speed is achieved by a method including, for example, the steps of calculating a TIJ printer's maximum speed on a real time basis to optimize the throughput of the TIJ printer so as to maintain the printer's power consumption within a specified power allotment. An apparatus according to the present invention includes a print head module that lays the ink on a substrate, e.g., a piece of paper, as per the specified area coverage. The substrate is moved towards a microwave ("$\mu$wave") dryer, i.e., the dryer module, that dries the liquid portion of the ink on the substrate. Both the print head module and the dryer module consume large amounts of power. Since the maximum power available is limited, the process speed is reduced as the area coverage increases due to the large heating requirements and the large number of drops to be laid. On the other hand, the process speed is increased as the area coverage decreases due to the lower heating requirements and a lower number of drops to be laid.

Owing to the sequential nature of the print and dryer modules, the power requirements of the two modules will be out of phase and, as a result, their instantaneous peak speeds may differ. The optimum process speed is the lower of the two, and the algorithm according to the present invention determines this. Calculation of the speed of the substrate through the dryer module and the printer module is performed using internal control electronics, such as a microprocessor, Random Access Memory (RAM), and/or Read Only Memory (ROM).

BRIEF DESCRIPTION OF THE DRAWINGS

The features described above and other features and characteristics of the present invention along with various methods of operation will become apparent to one skilled in the art to which the present invention pertains upon a study of the following illustrative embodiments along with the appended claims and drawings, all of which form a part of this specification. In the drawings:

DESCRIPTION OF ILLUSTRATIVE EMBODIMENTS

Figure 1:
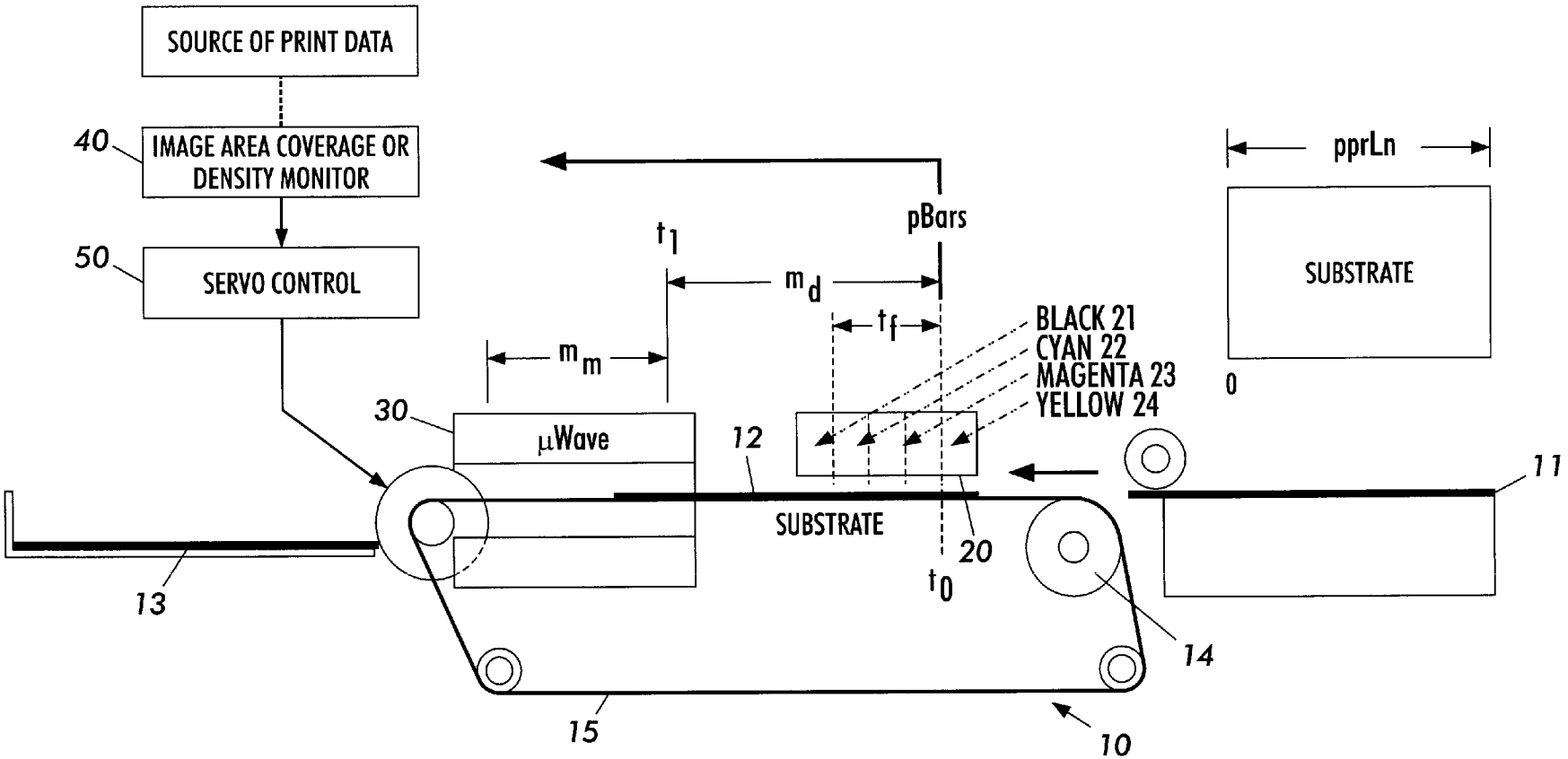
FIG. 1 depicts a schematic diagram of a thermal ink jet printer.

FIG. 1 is a schematic/functional block diagram of a TIJ printer, which includes several operating modules that have separate and independent power requirements. For example, printer 1 includes a print head, a dryer, such as a wave dryer, a paper feed, register, transport and stack mechanisms, drives, electrical module, etc. The algorithm according to an aspect of the present invention is embodied in TIJ printer 1 shown in FIG. 1, which for the sake of clarity only illustrates key modules of the printer.

Transport module 10 register s substrate 12 fed from input tray 11 and carries it under print head module 20. Print head module 20 includes four print bars ("pBars") where black 21 and three colored inks, cyan 22, magenta 23, and yellow 24, are applied to substrate 12, per the specified area coverage, on the top surface of substrate 12. Substrate 12 is then passed through dryer module 30, which includes $\mu$wave dryer 31, where the inks are dried. The dried prints are stacked in output tray 13. Encoder 14, which is driven by transport belt 15, provides timing for the operation of print head module 20. Encoder 14 is also used to sample the print bar electrical currents for the area coverage or density monitor 40.

In a home or office, the printer's power is typically restricted to 1.5 kva which imposes a restriction on the power available to each module, individually and collectively. Print head module 20 and dryer module 30 require power levels that monotonically increase with respect to the area coverage and the processing speed, i.e., the higher the area coverage or processing speed, the greater the power demand, and vice versa. Power needs of the other modules mentioned above do not vary significantly with area coverage or processing speed. In order to print and dry images of larger area coverages, the process speed is lowered so as to stay within allotted power requirements. However, at any given instant, due to the sequential nature of print head module 20 and dryer module 30, the power requirements of these two modules will be out of phase, and, as a result, the instantaneous tolerable peak speeds may differ through the two modules. When this is true, the optimum process speed is the lower of the two speeds.

The algorithm used to dynamically compute in real time the print head and dryer modules tolerable peak speeds and, in turn, the optimum instantaneous process speed is described with reference to FIGS. 2–4. Print head module 20 stores energy in capacitors (not shown), thus enabling on-demand temporal integration of power available to the print heads 21–24. The $\mu$wave dryer unit 31 does spatial integration of energy over $\mu$wave area to avail energy so as to dry the liquid portion of the ink.

The real time image area to be dried is represented by a running sum ("RS") of AC/line over the $\mu$wave length ("mm"). Some information must be input to the algorithm, either by asking the user to enter the information on the user's monitor or by storing the most common information in a Read-Only-Memory ("ROM"), which can be overwritten by the user if necessary. Information coming from a ROM may at least be verified by the user. The inputs to the algorithm are the instantaneous pBar currents, Yi, Mi, Ci, and Ki, measured in a space domain (transport belt motion) via transport belt 15 driven encoder pulses or the pixel counts/line from the source print data. For conciseness, the algorithm measures and is described in terms of pBar currents. However, pixel counts/line work equally as well, and often times better. The pBar currents/line have a 1:1 relationship with the number of pixels laid down by the pBars/line. Knowing the number of laid pixels/line by each pBar and properly summing (taking the phase lag of laying pixels of different colors, C, M, Y, and K into consideration) them for a given line on the substrate passing through the printer and the total number of jets/line, the AC/line can be computed. Maintaining the running sum (RS) of the AC/line over the pwave length, mm, for the portion of substrate 12 that is in $\mu$wave dryer 31, the instantaneous average image area coverage, AC, is found. The $\mu$wave dryer 31 has to dry the thus determined area coverage. Hence, the instantaneous average area coverage (AC) can be inferred from the pBar currents via computing the running sum, RS. Some pertinent parameters of the algorithm are shown below:

Printbar positions: Yellow, Magenta, Cyan, Black, with yellow being the first ink color applied and black the last.

spi=601 or 23.6614 lines/mm.

Heater current/pixel=150 mAmp.

No. of pulses per mm=5.143, No. lines per pulse= 23.6614/5.14=4.6 lines/pulse.

Pixels/line=13(384)=4992.

pprLn=Paper length=279.4 mm=23.6614 lines/mm(279.4 mm)=6611 lines.

d=spacing between printbars=20 mm=20 mm (23.6614 lines/mm)=473.23 lines.

$m_d$=delay bet$^n$ LE at pBar to $\mu$wave=105 mm=105 mm (23.6614 lines/mm)=2484.4 lines.

$m_m$=$\mu$wave length=169 mm=23.6614 lines/mm (169 mm)=3998.8 lines.

$m_0=m_d-3d=2484.4-1419.7=1064.7$.

docPitch=12 (28 mm)=23.6614 lines/mm (336 mm)= 7950.24 lines.

No. of pages in a document=n.

$t_0$=LE of first page of document at first pBar.

$t_f$=TE of last page of document at last pBar $t_i$=LE of first page of document at $\mu$wave start.

$t_t$=TE of last page of document at wave start $t_f=t_0+(n-1)$document pitch+pprLn+3d=$t_0$+7950.24(n−1)+ 6611+1419.7=8030.7+7950.24(n−1)+$t_0$ $t_1=t_0+m_d=2484.4+t_0$ $t_i=t_i+(n-1)$docPitch+pprLn=2484.4+$t_0$+7950.24(n−1)+ 6611=9095.24+7950.24(n−1)+$t_0$ For a particular design of printer used by the assignee of this application, the specifics are as follows. One skilled in the art to which the present invention pertains would understand that as the printer model in use changes, so do the specifics. Thus, the following description is for the sake of example only.

Amps/pixel=0.15.

Number of printed pixels/line/pBar=(pbar current amps/line)/(0.15 amps/pixel)=6.67(pBar current amps/line).

% AC/line=(6.67 (100)(pBar current amps/line))/(Number of jets in a line)=667 (pBar Current amps/line)/4992=0.1335 (pbar Current amps/line)

% AC over $\mu$wave=$\Sigma^m$ m (% AC/line)/(($\mu$Wave length)(scan lines/mm))=$\Sigma^m$ m (% AC/line)/((169 mm)(23.66 lines/mm))=$\Sigma^m$ m (% AC/line)/3998.5=$\Sigma^m$ m(0.1335 (pbar current amps/line) )/3998.5=3.3397 e−5 $\Sigma^m$ m pBarCurrents amps/line, and RS=$\Sigma^m$ m (pBar Current pixels/line), i.e., %AC over $\mu$wave=3.3397 e−5 (RS).

Figure 2:
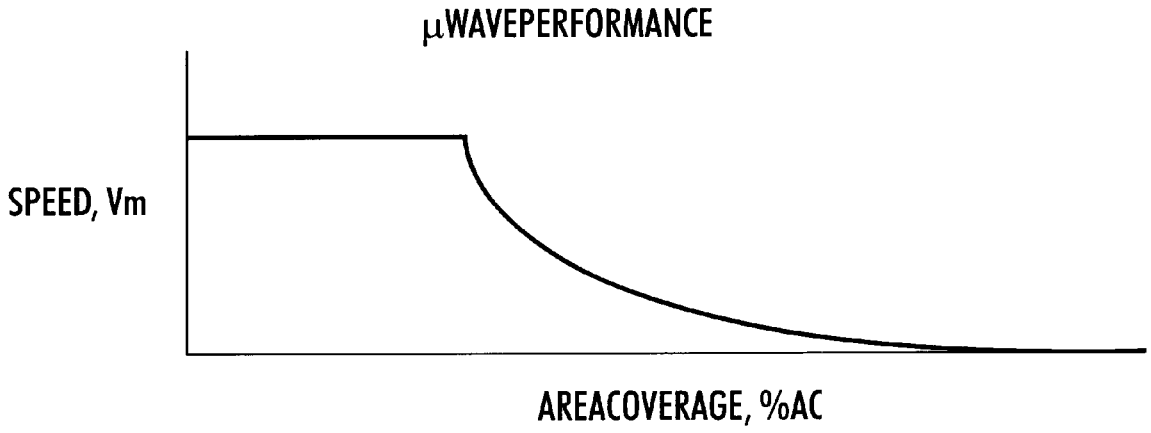
FIG. 2 is a graph showing the tolerable peak microwave ("$\mu$wave") process speed versus percent area coverage.

For a given maximum power, the $\mu$wave tolerable peak speed has, as shown in FIG. 2, an inverse relationship with the AC and in turn with the RS. The relationship can be explained as follows:

Ink on paper, AC=X pl/mm of paper length (pprLn).

Energy need to dry ink on paper=j Joules/pl.

Required energy/mm of paper=j*X Joules/mm of pprLn.

Power Required Z=Energy/mm or pprLn*process speed= $j*X*V_p$.

For a given maximum power of z watts, the tolerable peak $\mu$wave speed, $V_m$, is found.

$$V_m=(\text{max power})/(\text{required energy/mm of paper length } (pprLn))=(z \text{ joules/sec})/(jX \text{ Joules/mm})=((z/j)/X) \text{ mm/sec.}$$

The relationship between the tolerable peak $\mu$wave speed $V_m$ to area coverage is an inverse relationship as shown in FIG. 2.

Figures 5A, 5B:
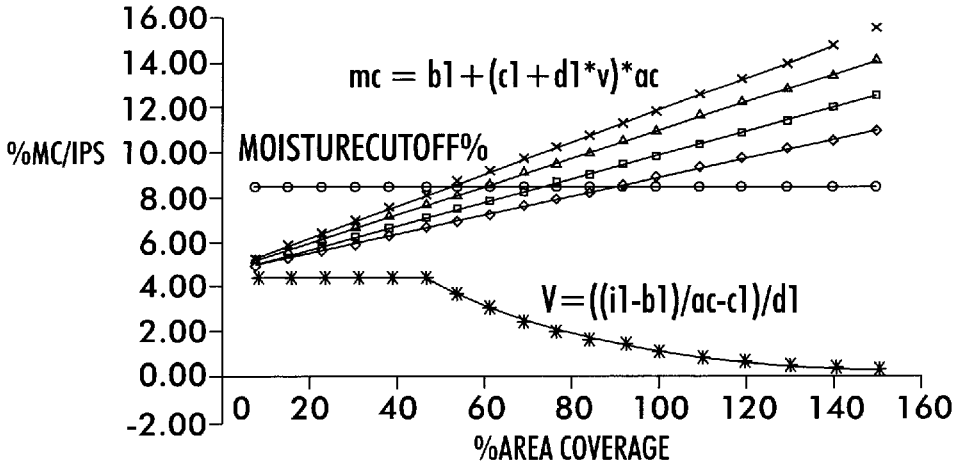
FIG. 5A is a chart showing an analysis of moisture content versus area covered.
FIG. 5B is a graph of the quantities presented in FIG. 5A.

From analysis of the empirical data shown in FIGS. 5A and 5B, the relationship of tolerable peak $\mu$wave speed for the particular printer being used was found to be:

$$V_m=\min(109.2,\ 2309.1(3.4/\%AC-0.023)),\ \text{mm/sec}$$

By substituting for % AC, we find the following expression for $V_m$.

$$V_m=\min(109.2,\ 2309.1(3.4/(3.3397e-5(RS))-0.023))=\min(109.2,\ 2309.1(10186.2/RS-0.023))\ \text{mm/sec}$$

Thus, by measuring the pBar currents in real time, the tolerable peak speed, $V_m$, for the $\mu$wave dryer can be computed. Similarly, as disclosed in U.S. Pat. No. 5,349,905, the contents of which are hereby incorporated by reference, the peak speed for the print head, $V_b$, can be computed from the pBar current measurements. Once the instantaneous speeds $V_m$ and $V_b$ are known, it is a simple matter for the printer to select the optimum throughput speed of the substrate being fed through the TIJ printer. The optimum throughput speed is the lesser of the two computed speeds. Servo control module 50 in FIG. 1 monitors and controls the drive speed to maintain the process speed in real time.

Figure 3:
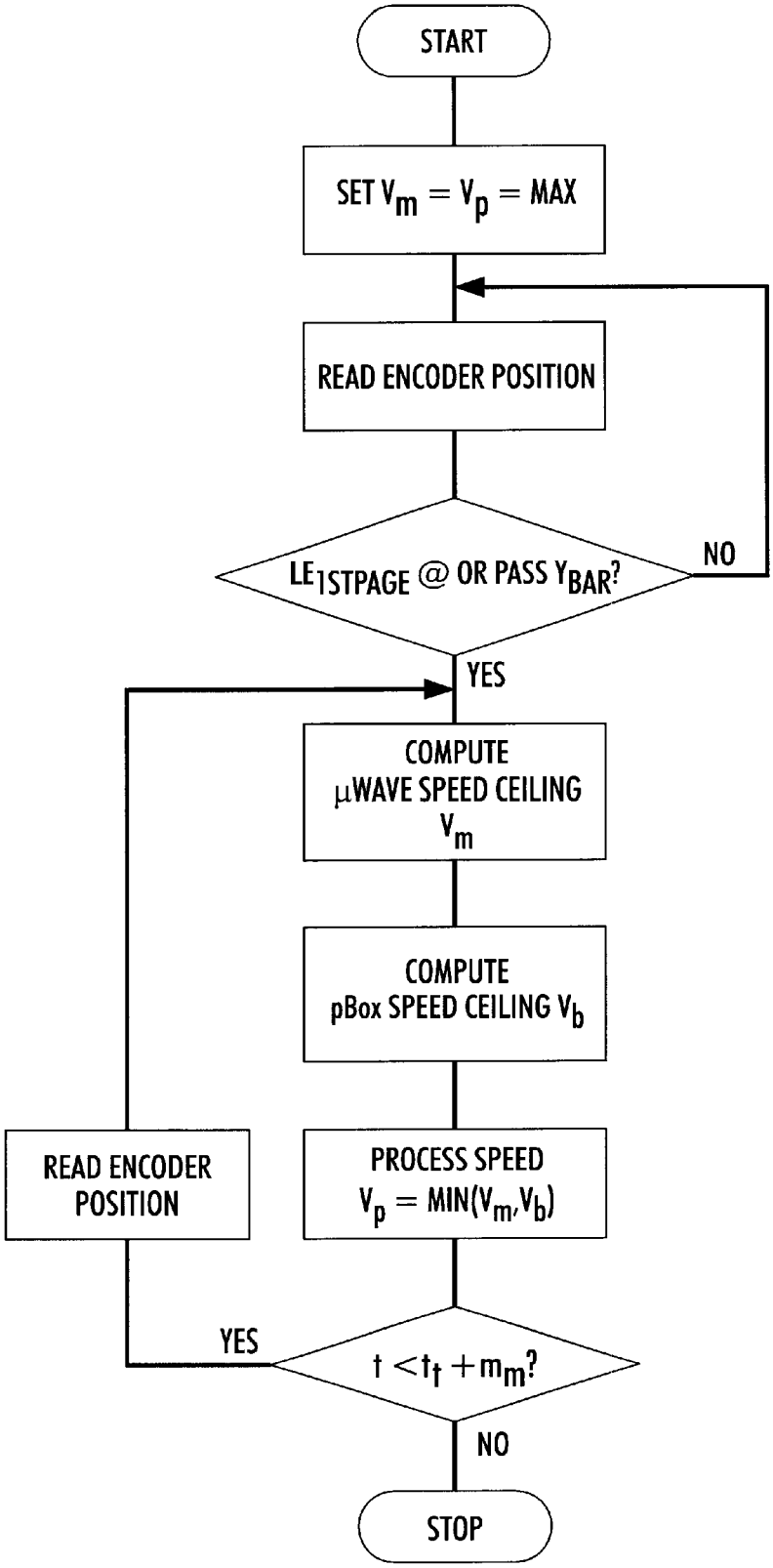
FIG. 3 is a flow chart for a variable speed algorithm for a thermal ink jet printer.
Figure 4:
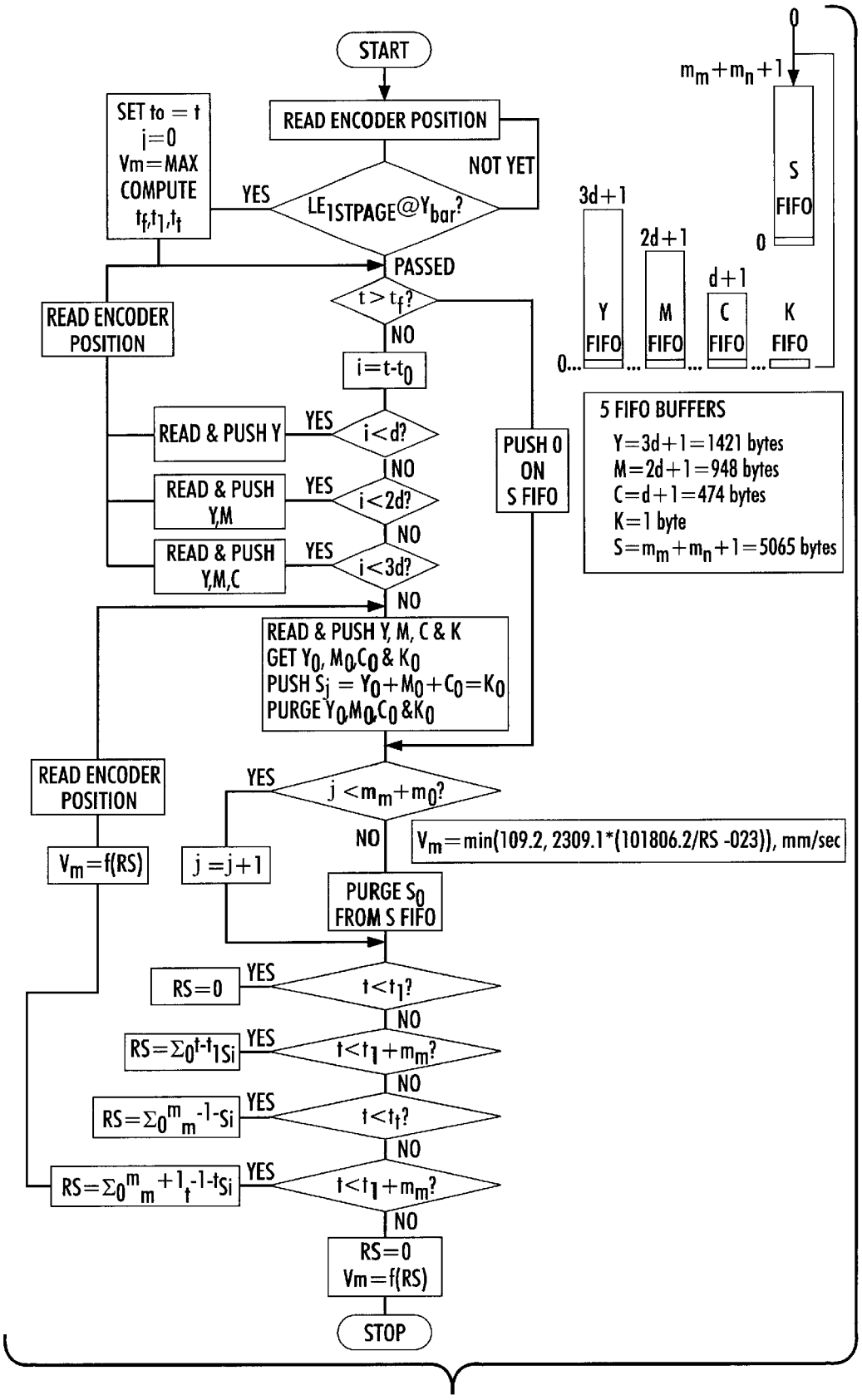
FIG. 4 is a flow chart indicating the $\mu$wave speed ceiling computation for a thermal ink jet printer.

FIGS. 3 and 4 are flow charts illustrating a process of computing the optimum process speed, see FIG. 3, and a process of computing instantaneous tolerable peak speed, $V_m$, of the $\mu$wave dryer, see FIG. 4. However, due to the fact that the processes depicted in the flow charts of FIGS. 3 and 4 are printer specific, and that these two FIGS. are relevant only to a specific TIJ printer, the drawings are not discussed in detail. Suffice it to say that the implementation of the algorithm requires the use of five FIFO buffers of the magnitude stated in FIG. 4. A person skilled in the art would realize that various modifications may be made to the flow charts of FIGS. 3 and 4 to ensure compatibility with other printers. For example, the value of d would be altered depending upon the printer and thus FIG. 4 would also change along with the value of d. Likewise, FIG. 3 would be altered by reading different encoder positions, which is a likely occurrence in different brands of printers. Thus, FIGS. 3 and 4 need not be described in any greater detail as one skilled in the art would clearly appreciate the changes made to these logic diagrams.

This invention may, however, be embodied in many different forms and should not be construed as being limited to the embodiment set forth herein. Rather, the illustrated embodiment is provided to convey the concept of the invention to those skilled in the art.

While this invention has been particularly shown and described with reference to a preferred embodiment thereof, it will be understood by those skilled in the art that various changes in form and details may be made without departing from the spirit and scope of the invention as defined by the appended claims.

We claim:

1. In a printer that includes a printer module and a dryer module having the capability to operate at different speeds and power consumption phases, a method of optimizing substrate throughput comprising:

determining instantaneous tolerable peak speeds for both the printer module and the dryer module in accordance with a given power available for said printer and dryer modules; and providing an instantaneous operating speed of the substrate which is the lower of the two instantaneous peak speeds determined in the determining step and using the operating speed as the speed for throughput of a substrate.

2. The method as claimed in claim 1, further comprising the step of applying the method to a thermal ink jet printer.

3. The method as claimed in claim 2, wherein the printer module includes four different ink colors comprising yellow, magenta, cyan, and black from start to finish of the substrate's direction of movement.

4. The method as claimed in claim 1, wherein the determining step is performed on a real time basis.

5. The method as claimed in claim 1, wherein the dryer module comprises a microwave dryer.

6. The method as claimed in claim 1, wherein a maximum throughput speed of said substrate is inversely related to image area coverage of the substrate.

7. The method as claimed in claim 1, further comprising the step of enabling respective power levels consumed the printer and dryer modules that are out of phase with one another.

8. A printer apparatus having an optimized speed at which a substrate is passed therethrough, said printer comprising:

a print head module that consumes a first power level;

a dryer module that consumes a second power level that operates out of phase with the first power level;

a controller that computes respective tolerable instantaneous peak speeds at which said substrate can be fed through both said print head module and said dryer module in accordance with a given power level available to both said print head module and said dryer module; and said controller selecting the lesser of the two tolerable peak speeds as the optimum instantaneous speed of said printer.

9. The printer apparatus as claimed in claim 8, wherein said printer is a thermal ink jet printer.

10. The printer apparatus as claimed in claim 8, wherein said print head module includes four ink print bars separated by a distance d.

11. The printer apparatus as claimed in claim 10, wherein said substrate encounters the four ink print bars in the following order: yellow, magenta, cyan, and black.

12. The printer apparatus as claimed in claim 8, wherein said substrate is a piece of paper.

13. The printer apparatus as claimed in claim 8, further comprising respective first and second power levels consumed by the dryer module and the print head module that are routinely out of phase with one another.

14. The printer apparatus as claimed in claim 8, wherein the dryer module includes a microwave dryer unit.

15. The printer apparatus as claimed in claim 8, wherein said printer further comprises:

a transport module that registers and carries an input tray;

an output tray where dried printed substrates can be stacked; and an encoder that provides timing for the print head module and samples currents found in the print head module to assist in calculating image area coverage.

16. A method of optimizing the instantaneous speed of a substrate traveling through a thermal ink jet printer, wherein the printer includes a print head module including four print bars and a dryer module including a microwave dryer that may operate out of phase relative to said print head module, and wherein a given shared power is available to operate both said print head module and said dryer module, the method comprising:

measuring currents applied to said print bars to determine a tolerable instantaneous peak speed of the substrate through the print head module in accordance with instantaneous power available to said print head module;

calculating a peak instantaneous tolerable speed of the substrate through the dryer module in accordance with instantaneous power available to said dryer module; and selecting the lower of the two tolerable instantaneous peak speeds as the printer's optimum instantaneous speed for the substrate traveling therethrough.

* * * * *